US005474290A

United States Patent [19]

Rascona et al.

[11] Patent Number: 5,474,290

[45] Date of Patent: Dec. 12, 1995

[54] FOOTBALL TRAINING MACHINE

[76] Inventors: Sebastian D. Rascona, 344 High St., Somerset, Pa. 15501; William C. Polacek, 137 Jacqueline Dr., Johnstown, Pa. 15904

[21] Appl. No.: 379,682

[22] Filed: Jan. 25, 1995

[51] Int. Cl.[6] ..... A63B 67/00

[52] U.S. Cl. ..... 273/55 R

[58] Field of Search ..... 273/55 R; 482/92, 482/900, 901, 903

[56] References Cited

U.S. PATENT DOCUMENTS

| | | | |
|---|---|---|---|
| 3,144,251 | 8/1964 | Gainey et al. | 273/55 |
| 3,329,428 | 7/1967 | Moran | 273/55 |
| 3,514,105 | 5/1970 | Pillard | 273/55 |
| 3,674,265 | 7/1972 | Sheets et al. | 273/55 R |
| 3,825,260 | 7/1974 | Thomas, Sr. | 273/55 R |
| 3,873,089 | 3/1975 | Krug | 273/55 R |
| 3,897,060 | 7/1975 | Jennings | 273/55 R |
| 3,907,291 | 9/1975 | Parker | 273/55 R |
| 3,942,796 | 3/1976 | Bowen | 273/55 R |
| 3,998,456 | 12/1976 | Sherman | 273/55 A |
| 4,447,056 | 5/1984 | Dalton | 273/55 R |
| 4,451,037 | 5/1984 | O'Hare | 273/55 R |
| 4,477,076 | 10/1984 | Monaco | 273/55 R |
| 4,508,341 | 4/1985 | Carrington | 273/55 R |
| 4,534,557 | 8/1985 | Bigelow | 273/55 R |
| 4,573,680 | 3/1986 | McNally | 273/55 R |

OTHER PUBLICATIONS

Adam Rogers, *Through a Glass, Darkly,* p. 52, Jan. 23, 1995, Newsweek.

*Primary Examiner*—Theatrice Brown

*Attorney, Agent, or Firm*—Eckert Seamans Cherin & Mellott; Kirk D. Houser; Walter J. Blenko, Jr.

[57] ABSTRACT

The application discloses an apparatus for use in conditioning and/or evaluating a football player or other athlete. The apparatus includes a blocking pad for movement from a first to a second position by a force which is applied thereto, a hydraulic cylinder with a movable rod interconnected with the blocking pad for resisting movement of the blocking pad with hydraulic pressure which opposes the force, a dissipating mechanism cooperating with the hydraulic cylinder for dissipating the hydraulic pressure when the force is removed, a returning mechanism for returning the blocking pad from the second to the first position with an independent force, and a frame for supporting the hydraulic cylinder. A flow control valve may control the flow rate of hydraulic fluid from the hydraulic cylinder to a bladder in an accumulator which has a compressed gas with a generally predetermined pressure. The flow control valve may freely permit a return flow of the hydraulic fluid from the bladder to the hydraulic cylinder whenever the gas pressure exceeds the hydraulic pressure of the hydraulic cylinder. A digital meter may display the force which is sensed by a load cell or pressure transmitter. Alternatively, a processor may collect and output samples of the force with respect to time, provide a start signal associated with a starting time, determine whether the blocking pad is being approached before the start signal, determine reaction time, and enunciate the start signal with a virtual-reality headset.

28 Claims, 12 Drawing Sheets

FOOTBALL TRAINING MACHINE

This invention relates to a general purpose exercise device. More particularly, this invention relates to a football training device which provides a yieldable resistance in response to a force applied by a person acting as a football blocker. This invention also relates to such a device which senses the applied force. This invention further relates to such a device which processes the applied force with respect to time.

A variety of proposals have been advanced for retarding the charging force applied to a football blocking apparatus. One proposal is shown in Jennings Patent U.S. Pat. No. 3,897,060 issued Jul. 29, 1975. The apparatus shown in the Jennings patent includes a fixed base with a movable blocking pad. Movement of the blocking pad by a player from its original position is resisted by one or two coil springs mounted within corresponding tubes. A pointer indicates the extent of axial movement and the amount of compression of the springs. A timer indicates the time between when the player raises his hand and starts his forward movement and when the player contacts the blocking pad. Return of the blocking pad to its original position is retarded by a recoil shock absorbing assembly within another tube which prevents an overly rapid return of the blocking pad to its original position in response to the recoil of the springs.

O'Hare Patent U.S. Pat. No. 4,451,037 issued May 29, 1984 discloses a mobile pushing exerciser apparatus with a stylus for recording force applied to the handle bars of the exerciser with respect to distance traveled by the exerciser. A stopwatch is activated and deactivated by movement of the handlebars to record time in motion.

Monaco Patent U.S. Pat. No. 4,477,076 issued Oct. 16, 1984 discloses a defensive reaction football blocking apparatus which simulates the snap of a football and the charge of an opposing offensive linesman. Sheets et al. U.S. Pat. No. 3,674,265 issued Jul. 4, 1972 also discloses a mechanism for simulating the snap of a football.

However, the apparatus shown in the Jennings, O'Hare, Monaco and Sheets et al. patents have not met desired standards in terms of easily and reliably measuring the speed and strength of a variety of dissimilar athletes, accurately sensing and displaying strength force, and evaluating such force with respect to time under simulated real world conditions.

We provide an apparatus for use in conditioning a football player. We provide a blocking pad mechanism for movement in a first direction from a first position to a second position by a first force which is applied thereto. We also provide a resisting mechanism interconnected with the blocking pad mechanism for resisting movement of the blocking pad mechanism in the first direction with a second force which opposes the first force. We further provide a dissipating mechanism cooperating with the resisting mechanism for dissipating all of the second force away from the blocking pad mechanism when the first force is removed therefrom. We also provide a returning mechanism for returning the blocking pad mechanism from the second position to the first position in a second direction, which is opposite from the first direction, with a predetermined independent third force. We further provide a frame mechanism for supporting at least the resisting mechanism. We may provide a sensing mechanism for sensing the first force.

We may provide a mechanism for adjusting the speed of movement of the blocking pad mechanism in response to the first force. We may also provide a hydraulic cylinder with a movable rod connected to the blocking pad mechanism, movable by the blocking pad mechanism in the first direction, and resisting movement of the blocking pad mechanism in the first direction with the second force. We may further provide a hydraulic cylinder holding hydraulic fluid and a piston which is driven by the movable rod. We may also provide a hydraulic cylinder with a port for transferring the hydraulic fluid therefrom when the piston is driven by the movable rod in the first direction. We may further provide a flow control mechanism interconnected with the port for controlling the flow rate of the hydraulic fluid. We may also provide an accumulator for holding the hydraulic fluid which flows from the port and through the flow control mechanism.

We may provide a holding mechanism for holding the hydraulic fluid which flows from the port and through the flow control mechanism. We may also provide a compressing mechanism for Compressing the holding mechanism with a generally predetermined pressure, and a hydraulic fluid return mechanism interconnected between the holding mechanism and the port for freely permitting a flow of the hydraulic fluid from the holding mechanism to the port whenever the pressure of the compressing mechanism exceeds the hydraulic pressure of the hydraulic fluid in the hydraulic cylinder.

We may provide a pressure transmitter for sensing the hydraulic pressure of the hydraulic fluid in the hydraulic cylinder and outputting a pressure signal. We may also provide a mechanism for inputting the pressure signal, converting the pressure signal to a force value, and displaying the force value. Alternatively, we may provide a load cell for sensing the first force. We may also provide a digital meter for displaying the first force.

We may provide a pair of bearing shafts which are parallel to the movable rod. We may also provide a blocking pad mechanism including a blocking pad, a sliding mechanism connected to the movable rod and slidable on the bearing shafts, and an extension arm connecting the blocking pad and the sliding mechanism. We may further provide a sliding mechanism including a pair of parallel plates and a mechanism interconnecting the plates. We may also provide plates with two bores along the longitudinal axis of the movable rod with each of the bores having a bearing for slidably engaging a corresponding one of the bearing shafts.

Alternatively, we may provide an apparatus for use in evaluating a football player. We provide a blocking pad mechanism for movement in a first direction from a first position to a second position by a first force which is applied thereto. We also provide a resisting mechanism interconnected with the blocking pad mechanism for resisting movement of the blocking pad mechanism in the first direction with a second force which opposes the first force. We further provide a dissipating mechanism cooperating with the resisting mechanism for dissipating all of the second force away from the blocking pad mechanism when the first force is removed therefrom. We also provide an output from the resisting mechanism with a signal which is related to the first force. We further provide a returning mechanism for returning the blocking pad mechanism from the second position to the first position in a second direction, which is opposite from the first direction, with a predetermined independent third force. We also provide a frame mechanism for supporting at least the resisting mechanism. We may provide a processor mechanism for inputting the signal from the resisting mechanism and determining the first force.

We may provide an input mechanism for inputting the signal, a converting mechanism for converting the signal to a force value equivalent to the first force, and an output mechanism for outputting the force value. We may also provide a mechanism for collecting samples of a time value with corresponding samples of the force value. We may further provide an output mechanism for outputting the samples of the force value with the corresponding samples of the time value.

We may provide a mechanism for outputting a start signal associated with the sample of the time value having an initial value. We may also provide a sensing mechanism located at a predetermined distance from the blocking pad mechanism for determining whether the blocking pad mechanism is being approached by an object before the start signal. We may further provide a mechanism for determining when the first force was applied to the blocking pad mechanism with respect to the start signal. We may also provide a virtual-reality mechanism for enunciating the start signal.

Alternatively, we may provide an apparatus for use in conditioning strength. We provide a moving mechanism for movement in a first direction from a first position to a second position by a first force which is applied thereto. We also provide a resisting mechanism interconnected with the moving mechanism for resisting movement of the moving mechanism in the first direction with a second force which opposes the first force. We further provide a dissipating mechanism cooperating with the resisting mechanism for dissipating all of the second force away from the moving mechanism when the first force is removed therefrom. We also provide a returning mechanism for returning the moving mechanism from the second position to the first position in a second direction, which is opposite from the first direction, with a substantially predetermined third force. We further provide a frame mechanism for supporting at least the resisting mechanism.

Other details, objects, and advantages of our invention will become more apparent as the following description of a present preferred embodiment thereof proceeds.

In the accompanying drawings, we have illustrated a present preferred embodiment of our invention in which.

Figure 1:
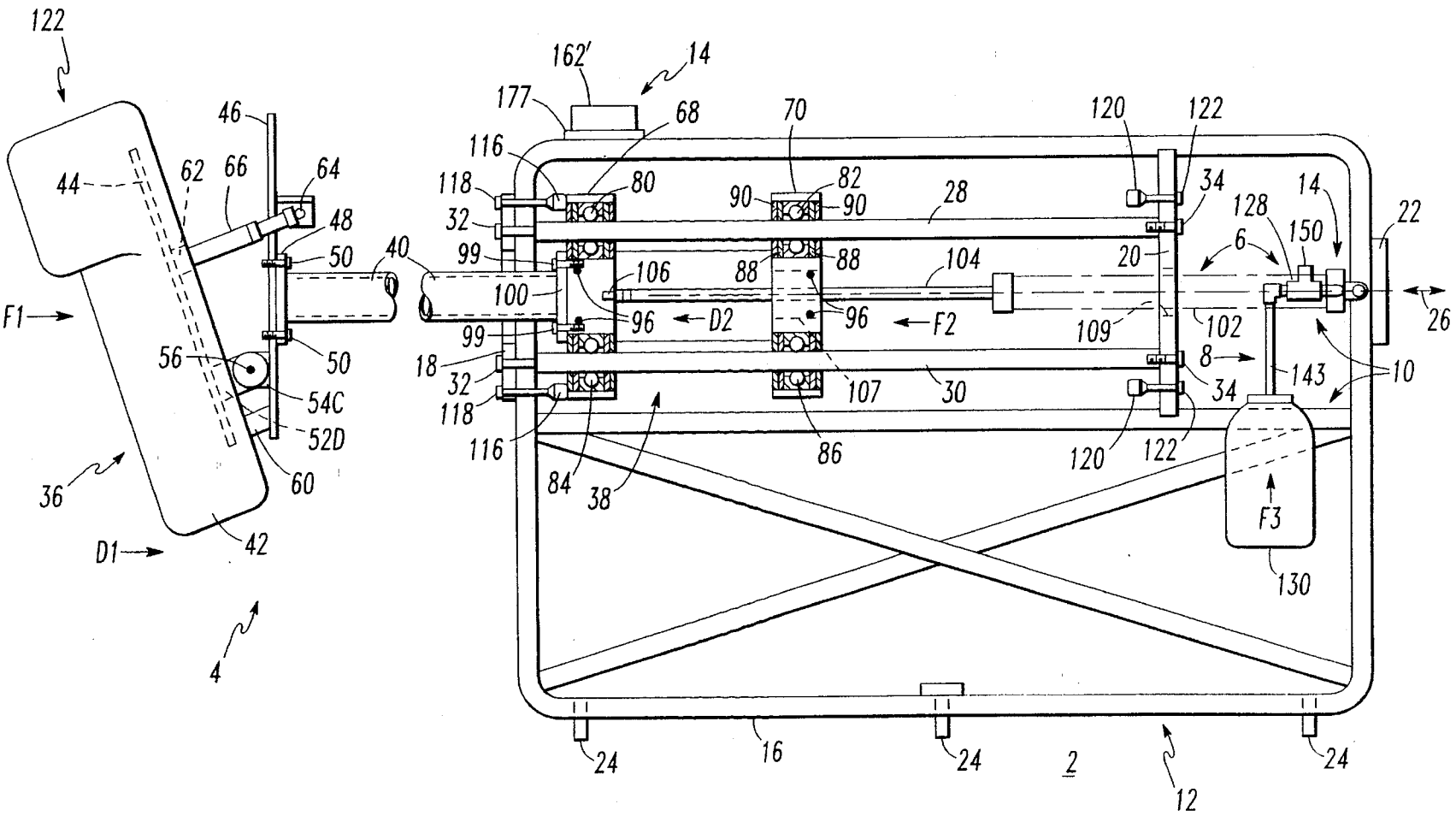
FIG. 1 is a side view of a football training machine in accordance with the invention.
Figure 2:
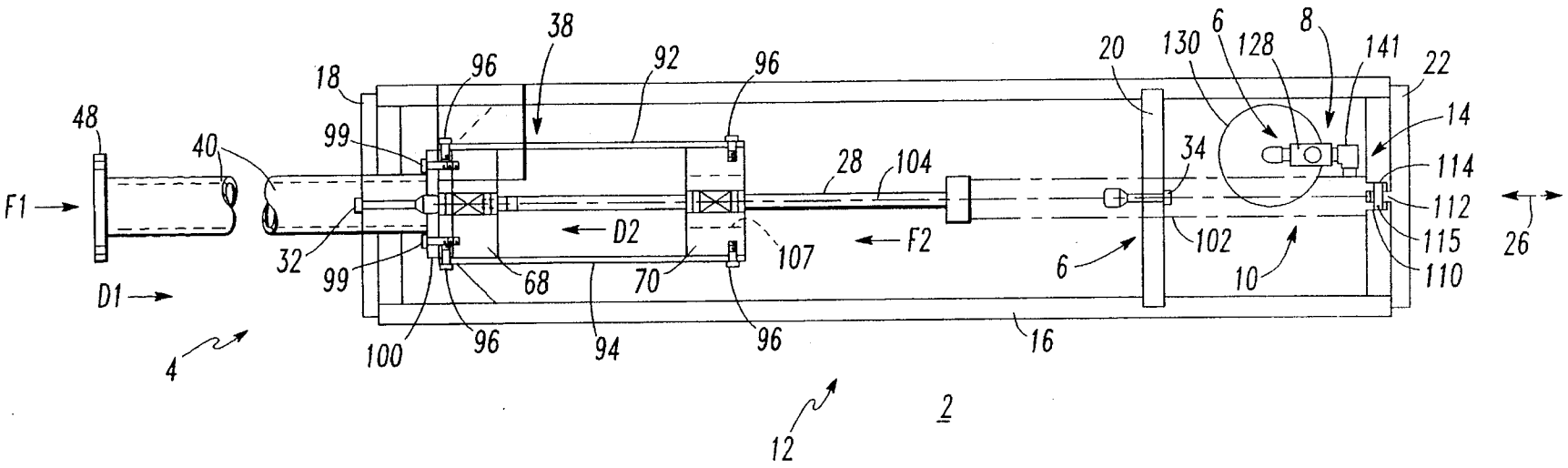
FIG. 2 is a top view of the football training machine of FIG. 1 with some parts not shown for simplicity.

Referring to FIGS. 1 and 2, a football training machine 2 is illustrated. The exemplary machine 2 is suitable for training, conditioning and evaluating the speed and strength of football players and a wide variety of other athletes. The machine 2 includes a blocking pad mechanism 4, a resisting mechanism 6, a dissipating mechanism 8, a returning mechanism 10, a frame mechanism 12, and a sensing mechanism 14. The blocking pad mechanism 4 is moved in a direction D1 by a force F1 which is applied to the blocking pad mechanism 4 (e.g., left to right in FIGS. 1 and 2). The exemplary force F1 is provided, for example, by an athlete who charges the blocking pad mechanism 4. The resisting mechanism 6 is interconnected with the blocking pad mechanism 4 and resists movement of the blocking pad mechanism 4 in the direction D1 with a force F2 (e.g., right to left in FIGS. 1 and 2) which opposes the force F1.

As explained in greater detail below with FIG. 7 the resisting mechanism 6 produces the opposing force F2 in response to the force F1 which moves the blocking pad mechanism 4 in the direction D1. Furthermore, the dissipating mechanism 8 cooperates with the resisting mechanism 6 and dissipates all of the force F2 away from the blocking pad mechanism 4 when the force F1 is removed from the blocking pad mechanism 4. In this manner, no energy is stored in the resisting mechanism 6 when the force F1 is removed and, therefore, the resisting mechanism 6 does not recoil and drive the blocking pad mechanism 4 in a direction D2 which is opposite the direction D1. As further explained below with FIG. 7, the returning mechanism 10 returns the blocking pad mechanism 4 in the direction D2 with a substantially predetermined independent force after the force F1 has been substantially removed from the blocking pad mechanism 4.

The exemplary frame mechanism 12 includes a welded frame 16 having forward (i.e., toward the left of FIGS. 1 and 2), intermediate and rear (i.e., toward the right of FIGS. 1 and 2) mounting plates 18, 20 and 22, respectively. The exemplary frame 16 is made of welded schedule 40 pipe. The frame 16 is suitable for both indoor and outdoor use and, further, includes a plurality of fasteners 24 which fixedly mount the frame 16 to a surface (not shown) such as a floor or the ground. Attached between the forward and intermediate mounting plates 18,20 along the longitudinal axis 26 of the frame 16 are an upper bearing shaft 28 and a lower bearing shaft 30 (shown in FIG. 1). The exemplary bearing shafts 28,30 are a 1.5 inch diameter, class "L", solid 60 case hardened and ground Thomson shaft marketed by American Bearing, although other shafts may be used. The shafts 28,30 are parallel to the directions D1,D2 and are each attached to the mounting plates 18,20 by screws 32,34, respectively.

Figure 3:
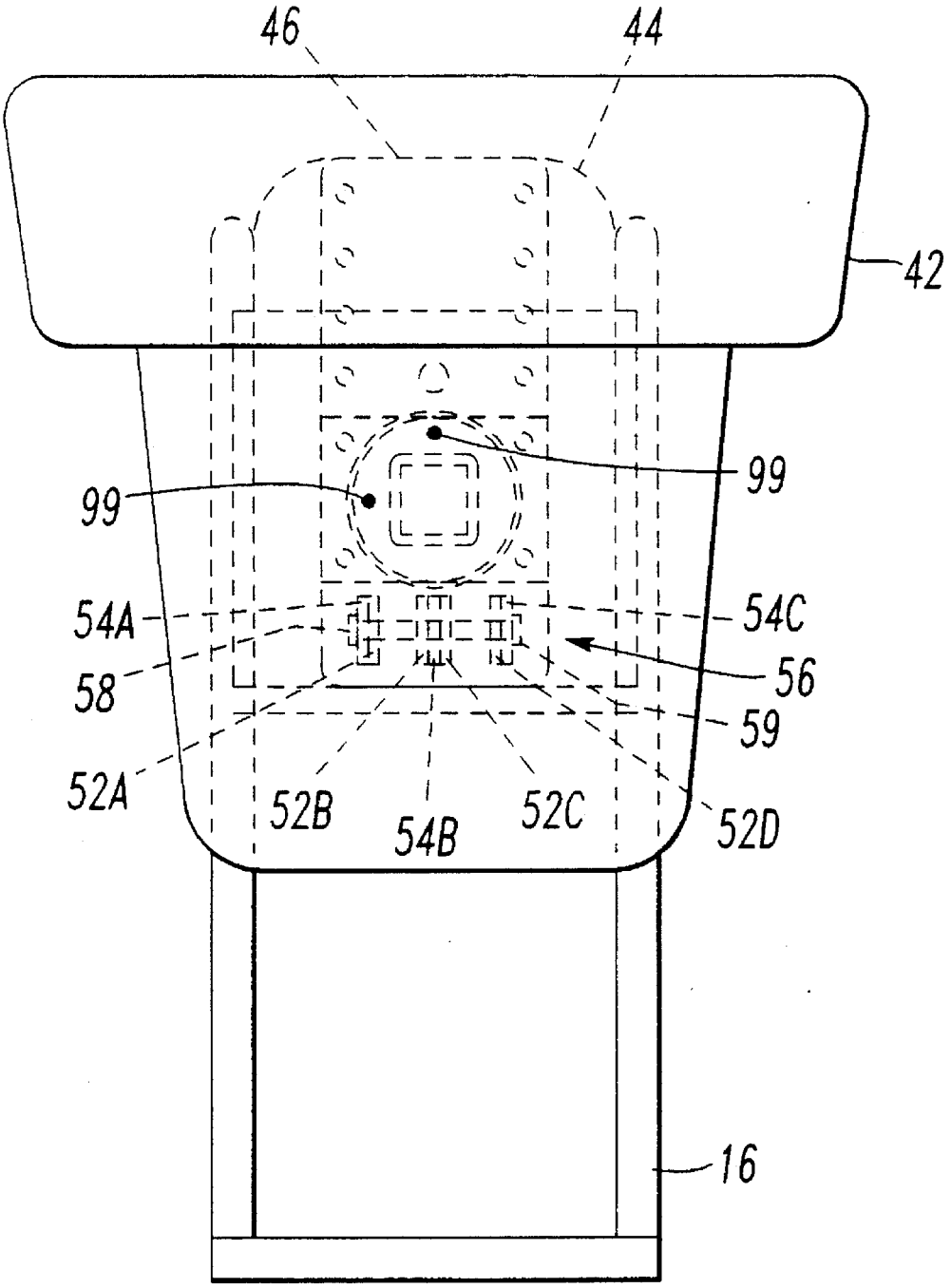
FIG. 3 is an end view of the football training machine of FIG. 1.

Continuing to refer to FIG. 1, the blocking pad mechanism 4 includes a blocking pad 36, a sliding mechanism 38 which is slidable on the bearing shafts 28,30, and an extension arm 40 which connects the blocking pad 36 and the sliding mechanism 38. The blocking pad 36 includes a pad 42, a pad support plate 44 (generally shown in phantom), and an extension arm attachment plate 46 which is attached to the forward end 48 of the extension arm 40 by a plurality of screws 50. Also referring to FIG. 3, the plate 44 has four pivot arms 52A,52B,52C,52D and the plate 46 has three pivot arms 54A,54B,54C which collectively pivot about a common pivot 56. The pivot 56 is formed by a clevis pin 58 which is secured by a prong cotter pin 59.

Still referring to FIG. 1, the pad support plate 44 has a lower stop 60 which engages the attachment plate 46 with full counter-clockwise rotation of the plate 44 about the pivot 56. Biased between a surface 62 of the pad support plate 44 and a surface 64 of the attachment plate 46 is a spring 66. The spring 66 retards clockwise rotation of the pad 42 about the pivot 56 in response to the force F1.

Figure 5:
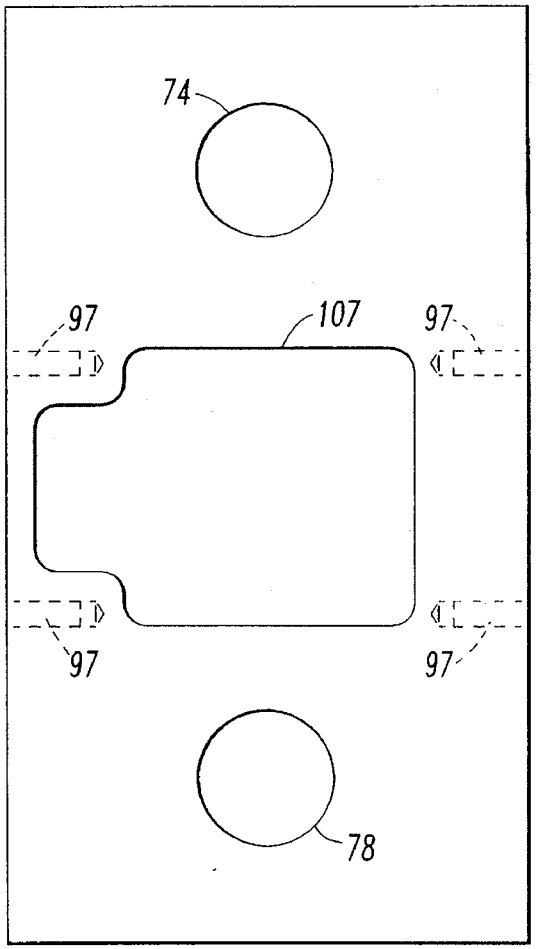
FIG. 5 is a plan view of a rear bearing retainer plate in accordance with the invention.
Figure 4:
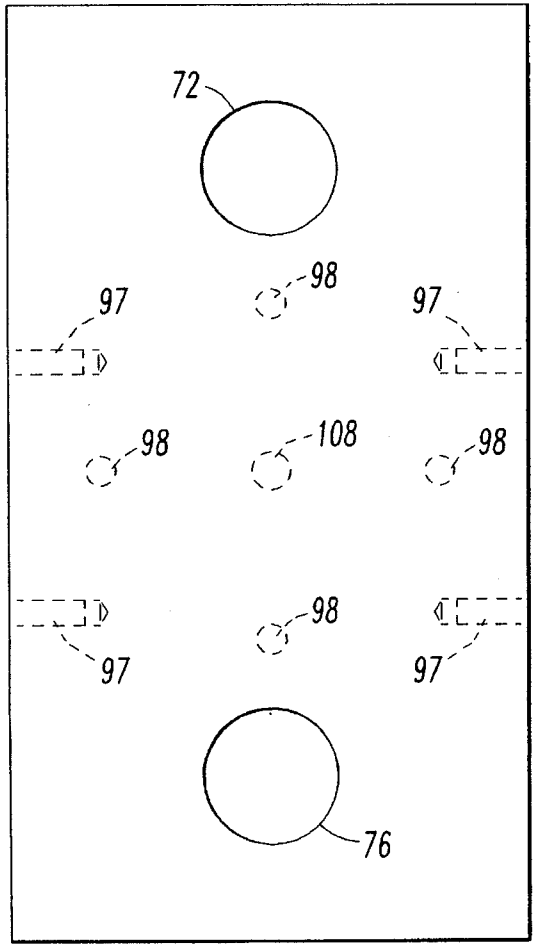
FIG. 4 is a plan view of a front bearing retainer plate in accordance with the invention.

Referring to FIGS. 1, 4 and 5, the sliding mechanism 38 includes a forward bearing retainer plate 68 and a reverse bearing retainer plate 70 which is parallel to the forward bearing retainer plate 68. The forward and reverse bearing retainer plates 68,70 have upper bores 72,74 and lower bores 76,78, respectively, as shown in FIGS. 4 and 5. The bores 72,74,76,78 have bearings 80,82,84,86, respectively, as shown in FIG. 1. The upper bearings 80,82 and the lower bearings 84,86 slidably engage the respective upper and lower bearing shafts 28 and 30. The exemplary bearings 80,82,84,86 are model SPB-24-ADJ ball bushing bearings manufactured by Thomson, although other bearings may be used. As shown with the bearing 82, each of the bearings 80,82,84,86 includes two stainless steel seals 88 and two retaining rings 90 which are disposed at opposite ends of such bearings within the respective bores 72,74,76,78.

Also referring to FIG. 2, the forward and reverse bearing retainer plates 68,70 are interconnected and supported by two support plates 92,94 (shown in FIG. 2) which are each attached to opposite sides of the bearing retainer plates 68,70 by four screws 96 in threaded mounting holes 97 (shown in FIGS. 4 and 5) of the plates 68,70. The sliding mechanism 38, formed by the plates 68,70,92,94 and the bearings 80,82,84,86, is slidably mounted on the bearing shafts 28,30 for slidable motion in the directions D1,D2 along the longitudinal axis 26 of the machine 2. The forward bearing retainer plate 68 has four forward threaded mounting holes 98 (shown in FIG. 4) for screws 99 which secure the rearward end 100 of the extension arm 40 to the plate 68. In this manner, the blocking pad 36 is slidable with the sliding mechanism 38.

Continuing to refer to FIGS. 1 and 2, the resisting mechanism 6 includes a hydraulic cylinder 102 with a movable rod 104 (shown in phantom in FIG. 2) at the forward end of the cylinder 102. The exemplary hydraulic cylinder 102 is a model MDL-2.50-HHC-36A-CC-PV cylinder marketed by the Sheffer Corporation, although other cylinders and resisting mechanisms may be used. The cylinder 102 is mounted along the longitudinal axis 26 of the machine 2 such that the movable rod 104 is movable along the longitudinal axis 26 and is parallel to the bearing shafts 28 30.

The threaded end 106 of the movable rod 104 passes through a hole 107 (best shown in FIG. 5) in the rear bearing retainer plate 70 and is threadably connected to a threaded mounting hole 108 (shown in phantom in FIG. 4) in the rear of the forward bearing retainer plate 68 such that the movable rod 104 is connected to and is movable with the sliding mechanism 38. In this manner, the resisting mechanism 6 is connected to the sliding mechanism 38 of the blocking pad mechanism 4.

As explained in greater detail below with FIG. 7, when the movable rod 104 of the cylinder 102 is moved by the sliding mechanism 38 of the blocking pad mechanism 4 in the direction D1, the rod 104 resists movement of the blocking pad mechanism 4 with the force F2. As shown in FIG. 1, a surface 109 of the intermediate plate 20 precludes any significant downward movement of the cylinder 102. The rear end of the cylinder 102 has a clevis mount 110, as shown in FIG. 2. The mount 110 of the cylinder 102 is fixedly mounted to and supported by an extension 112 of the rear mounting plate 22 of the frame mechanism 12 by a clevis pin 114 which is secured by a prong cotter pin 115.

Figure 6:
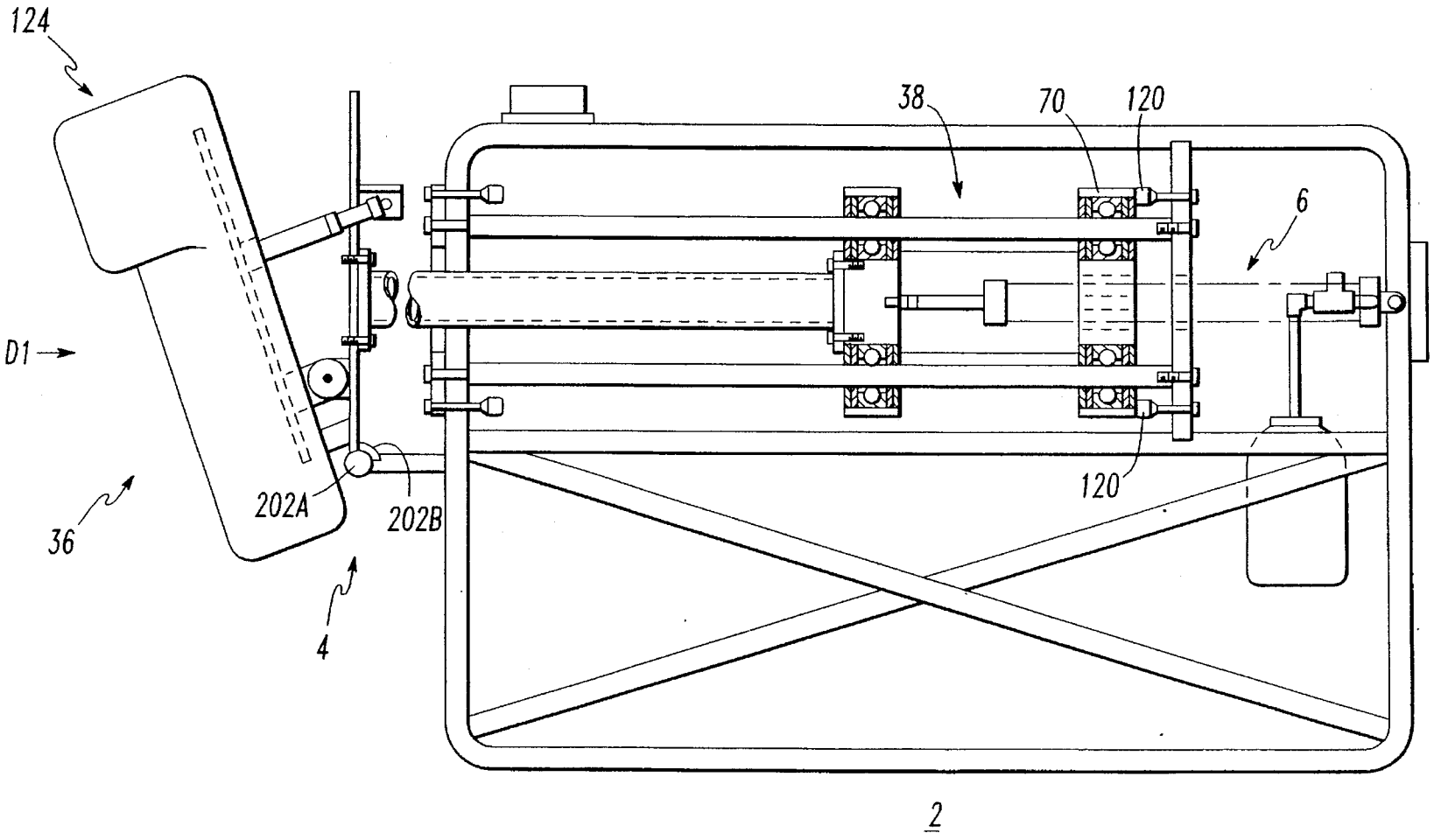
FIG. 6 is a side view of the football training machine of FIG. 1 with the blocking pad in a fully engaged position.

As shown in FIG. 1, the forward mounting plate 18 includes a plurality of rearwardly disposed protective bumpers 116 which are secured thereto by screws 118. In this manner, the forward travel of the forward bearing retainer plate 68 in the direction D2 is limited by the bumpers 116. The intermediate mounting plate 20 includes a plurality of forwardly disposed protective bumpers 120 which are secured thereto by screws 122. As shown in FIG. 6, which illustrates the machine 2 with the blocking pad 36 in a fully engaged rearward position, the rearward travel of the rear bearing retainer plate 70 in the direction D1 is limited by the bumpers 120. Accordingly, the blocking pad mechanism 4 moves from the initial position 122 of FIG. 1 to the final position 124 of FIG. 6 in the direction D1. In this manner, in the exemplary embodiment, the sliding mechanism 38 and the blocking pad mechanism 4 have a total travel distance of about 2.5 feet. This distance approximates the distance over which a football lineman must charge and push back the blocking pad 36 which simulates an opposing lineman. As discussed below with FIG. 7, the resisting mechanism 6 resists movement of the blocking pad mechanism 4 in the direction D1 from the initial position 122 of FIG. 1 to the final position 124 of FIG. 6.

Figure 7:
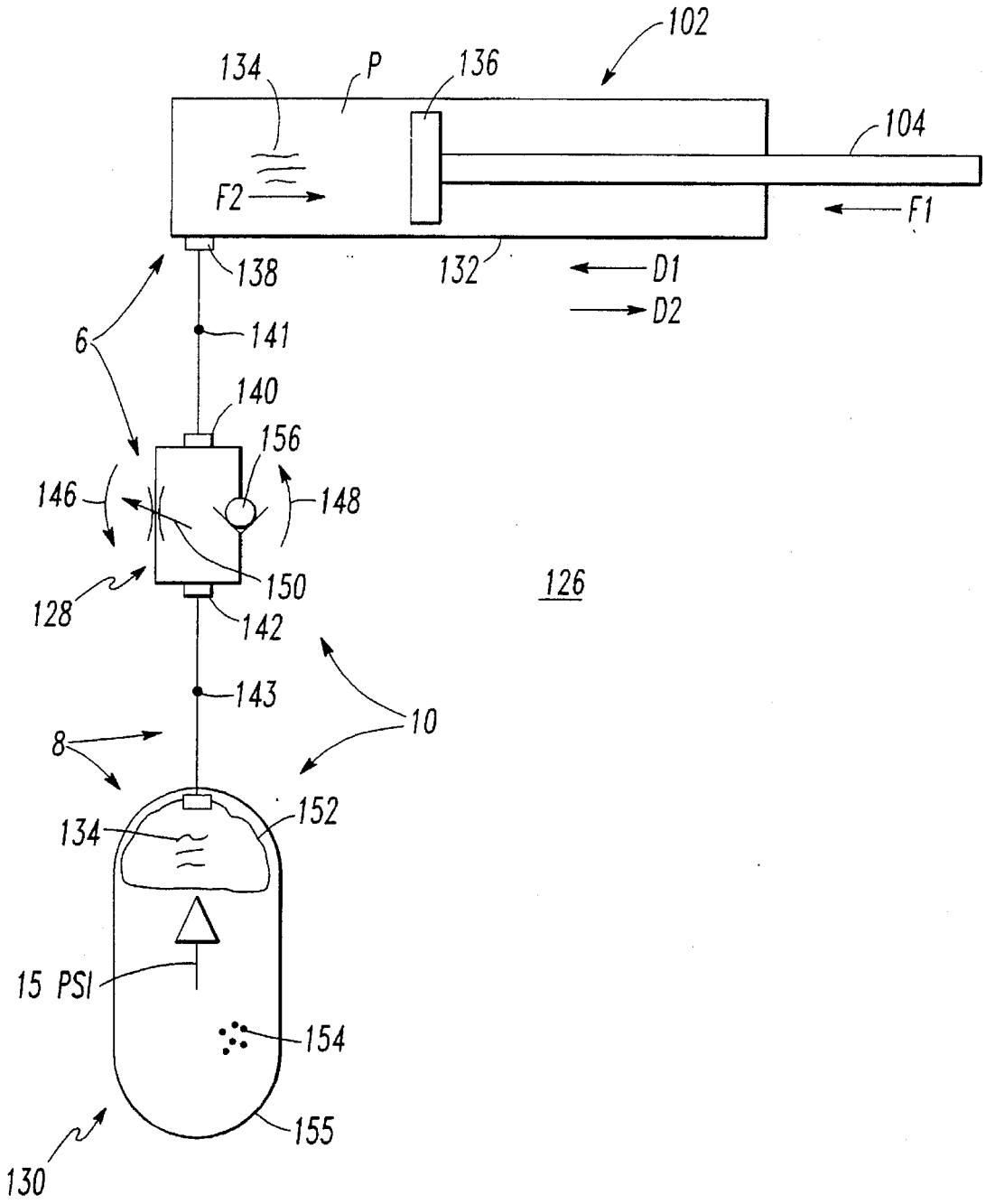
FIG. 7 is a schematic diagram of the hydraulic subsystem of the football training machine of FIG. 1.

FIG. 7 illustrates a schematic diagram of a hydraulic sub-system 126 of the machine 2 of FIG. 1. The hydraulic sub-system 126 includes the hydraulic cylinder 102, a flow control valve 128 and an accumulator 130. The exemplary flow control valve 128 is a Series F flow control valve model FT257/5-3/4 NPT BAR 400 marketed by Parker Fluidpower and the exemplary accumulator 130 is a model 30A-1A marketed by Greere, although other valves and accumulators may be used. As schematically shown in FIG. 7, the hydraulic cylinder 102 has a cylinder 132 holding hydraulic fluid 134, a piston 136 interconnected with the movable rod 104, and a port 138. The port 138 is interconnected with a first port 140 of the flow control valve 128 by a fluid line 141. The second port 142 of the flow control valve 128 is interconnected with the accumulator 130 by a fluid line 143.

The flow control valve 128 has a first flow direction 146 from the first port 140 to the second port 142. The valve 128 also has a second flow direction 148, which is opposite the first direction 146, from the second port 142 to the first port 140. The valve 128 provides precision flow control and full shutoff in the first flow direction 146 under the control of an adjusting knob 150 (shown schematically by the arrow 150). The valve 128 further automatically provides unrestricted free flow in the second flow direction 148.

The hydraulic fluid 134 flows from the port 138 and through the flow control valve 128 in response to the force F1. Whenever the movable rod 104 drives the piston 136 in the direction D1 in response to the force F1, the piston 136 drives and transfers the hydraulic fluid 134 from the port 138. In turn, the hydraulic fluid 134 flows through the fluid line 141 into the first port 140 and out of the second port 142 of the flow control valve 128. The operation of the hydraulic cylinder 102 is generally described by Equations 1 and 2:

$$F1=A*P \qquad \text{Eq. (1)}$$

$$S=Q\div A \qquad \text{Eq. (2)}$$

where:

A is the area of the piston 136;

P is the pressure of the hydraulic fluid 134;

S is the speed of travel of the movable rod 104; and

Q is the flow rate of the hydraulic fluid 134 out of the port 138.

The flow control valve 128 produces a hydraulic pressure drop (P') which is related to the flow of the hydraulic fluid 134 from the port 138 and through the valve 128. The valve 128 accommodates a variety of pressures (P') between approximately 10 and 400 PSI. The valve 128 generally provides a known direct functional relationship between the flow of the hydraulic fluid 134 therethrough and the pressure drop (P') across the ports 140,142 in the first flow direction 146. This relationship is generally represented by Equation 3:

$$Q=k*f(P') \quad \text{Eq. (3)}$$

where:

k is an adjustable constant.

Also referring to FIG. 1, the adjusting knob 150 facilitates adjustment of the relationship of Equation 3 by permitting a greater flow at a given pressure when the knob 150 is opened (e.g., a greater value of the adjustable constant k) and a smaller flow at the same pressure when the knob 150 is closed (e.g., a smaller value of k). In this manner, the speed of movement (which is directly related to the flow rate Q) of the blocking pad mechanism 4 in the direction D1 in response to the force F1 (which is directly related to the pressure P) is adjusted by the knob 150 (which adjusts the flow rate of the hydraulic fluid 134 flowing from the port 138 at a given pressure drop P' that follows the pressure P). Therefore, the speed of movement (S) at a given value of the force F1 is readily adjusted by the relatively simple mechanical operation of the knob 150. Accordingly, this adjusts the degree of difficulty of the machine 2 for a person using such machine.

In this manner, the blocking pad mechanism 4 is movable in the direction D1 by a wide variety of forces. The machine 2 accommodates, with a simple and minor modification of the knob 150, widely differing applied forces F1. Moreover, the machine 2 can be used by persons of greatly differing strengths (e.g., relatively small athletes, such as grade school or junior high students, and relatively large athletes, such as high school, collegiate and professional football players).

Continuing to refer to FIG. 7, the hydraulic fluid 134 flows from the second port 142 of the flow control valve 128 to the accumulator 130 in the fluid line 143. The dissipating mechanism 8 includes the fluid line 143 and the accumulator 130 which holds the hydraulic fluid 134 that flows from the port 138 of the cylinder 102 and through the flow control valve 128. The accumulator 130 includes an expandable bladder 152 which holds therein the hydraulic fluid 134 from the flow control valve 128.

The returning mechanism 10 includes a compressed gas 154 within a chamber 155 in the accumulator 130 and a hydraulic fluid return mechanism 156 within the flow control valve 128. The exemplary compressed gas 154 is nitrogen compressed with a generally predetermined pressure of about 15 PSI (above atmospheric pressure) within the chamber 155 which also holds the bladder 152. The size of the chamber 155 is sufficiently larger than the size of the bladder 152 in order that the pressure within the chamber 155 remains substantially constant. Accordingly, when the blocking pad mechanism 4 of FIG. 1 is moved in the direction D1, the pressure (P) of the hydraulic fluid 134 in the cylinder 132 is about equal to the pressure drop (P') across the ports 140,142 of the valve 128 in the first flow direction 146 plus the exemplary 15 PSI pressure of the gas 154.

The bladder 152 is interconnected by the fluid line 143 with the second port 142 of the flow control valve 128. The first port 140 of the flow control valve 128 is connected to the port 138 of the hydraulic cylinder 102 by the fluid line 141. The compressed gas 154 facilitates a return transfer of the hydraulic fluid 134 from the bladder 152 in the second flow direction 148 (i.e., from the second port 142 to the first port 140) of the flow control valve 128. The hydraulic fluid return mechanism 156 freely permits this return flow of the hydraulic fluid 134 from the bladder 152 to the port 138 of the cylinder 102 whenever the generally fixed pressure of the gas 154 exceeds the hydraulic pressure of the cylinder 102.

Continuing to refer to FIGS. 1 and 7, whenever an athlete hits the blocking pad mechanism 4 at the front of the machine 2, the resulting movement of the piston 136 by the rod 104 sends a surge of pressure into the back of the cylinder 102. The hydraulic fluid 134 therein flows in the first flow direction 146 from the first port 140 to the second port 142 of the flow control valve 128 which controls the flow (Q) therethrough and produces the pressure drop (P') thereacross. The fluid 134 flows into the pressurized bladder 152 which is charged by the compressed gas 154. Then, after the athlete moves the blocking pad mechanism 4 to the final position 124 of FIG. 6, the rod 104 and the piston 136 are stationary, and the hydraulic pressure (P) and the flow (Q) of the fluid 134 are zero. Finally, at this point, the compressed gas 154 provides a slight return pressure which returns the fluid 134 to the cylinder 102 and gently moves the blocking pad mechanism 4 back to its original position 122 of FIG. 1.

In this manner, the machine 2 is safe to both users and bystanders during operation thereof. The resisting mechanism 6 does not recoil and does not drive the blocking pad mechanism 4 in the opposite direction D2. Instead, the hydraulic fluid 134, under the pressure of the compressed gas 154 gently moves the blocking pad mechanism 4 in the direction D2 with a substantially predetermined independent force, in the absence of a nominal force F1, after the hydraulic fluid 134 has been discharged from the cylinder 102. This occurs when the hydraulic pressure (P) and the flow (Q) of the fluid 134 approach zero and, therefore, occurs when the force F1 has been substantially removed from the blocking pad mechanism 4 and, also, when the corresponding force F2 has been substantially dissipated by the dissipating mechanism 8.

Figure 8:
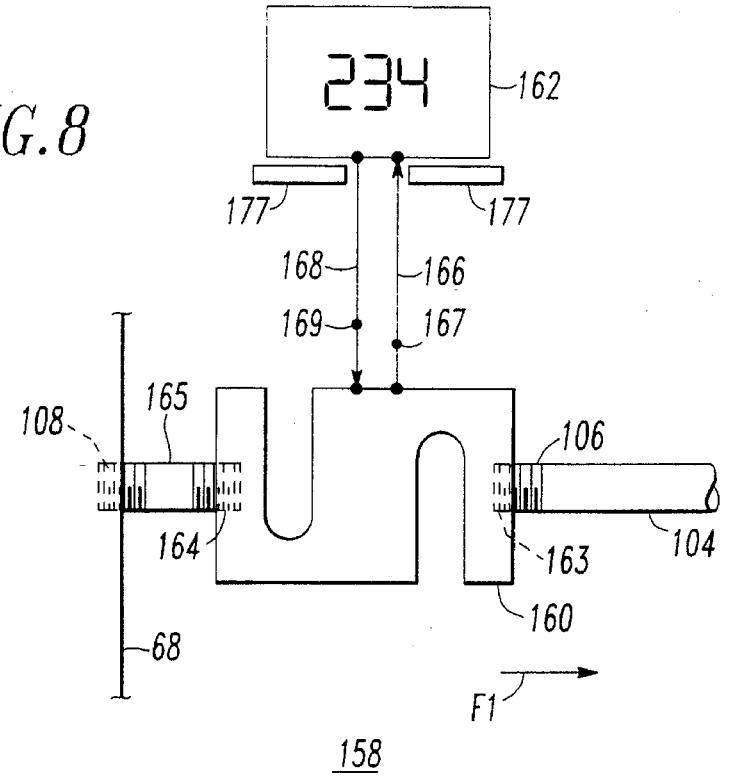
FIG. 8 is a schematic diagram of a sensing subsystem of a football training machine in accordance with the invention.

Referring to FIG. 8, a schematic diagram of a sensing sub-system 158 is illustrated. The sub-system 158 includes a load cell 160 for sensing the force F1 and a digital meter 162 with a light emitting diode (LED) display for displaying a digital readout of the force F1. As shown in FIG. 8, the threaded end 106 of the movable rod 104 is threadably attached to a threaded hole 163 on one side of the load cell 160. A threaded hole 164 on the other side of the load cell 160 is threadably attached to a threaded rod 165 which, in turn, is threadably attached to the threaded hole 108 on the rear of the forward bearing retainer plate 68 of FIG. 4. In this manner, the end 106 of the rod 104 is interconnected and movable with the forward bearing retainer plate 68 in a similar manner as discussed above with FIG. 1. The exemplary load cell 160 and meter 162 are models LCCA and DP205-S, respectively, marketed by Omega, although other sensors and display mechanisms may be used. The load cell 160 accurately senses the force F1 and produces an electrical signal 166 on line 167 in response to an excitation signal 168 on line 169 from the meter 162. In turn, the electrical signal 166 is converted and displayed in digital form by the meter 162.

Figure 9:
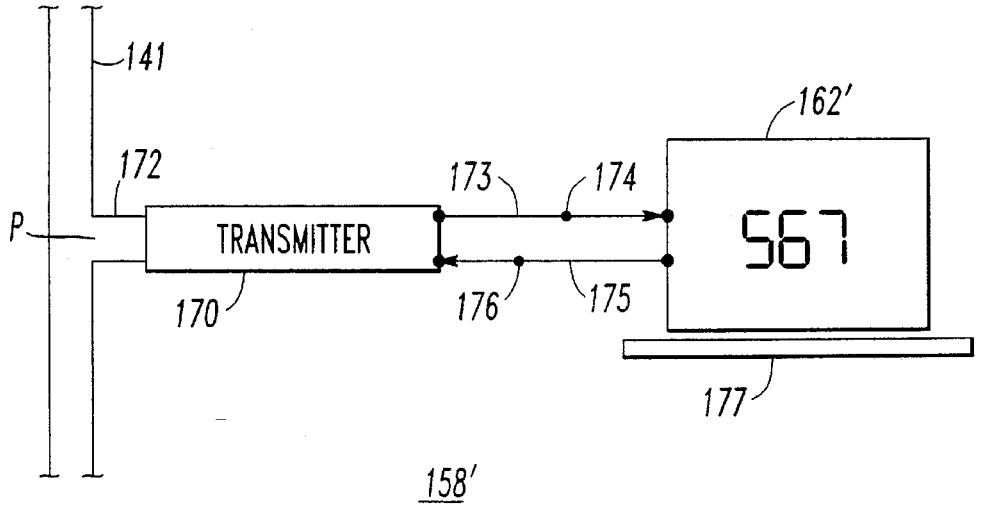
FIG. 9 is a schematic diagram of another sensing subsystem in accordance with an alternative embodiment of the invention.

Referring to FIG. 9, an alternative sensing subsystem 158' is illustrated. The exemplary sensing sub-system 158' includes an alternative digital meter 162' and a pressure transmitter 170 which is connected to a T-connection 172 in the fluid line 141 between the port 138 of the hydraulic cylinder 102 and the first port 140 of the flow control valve 128 of FIG. 7. The exemplary transmitter 170 and meter 162' are models PX605-500GI thin film pressure transmitter and DP205-E, respectively, marketed by Omega, although other sensors and display mechanisms may be used. The transmitter 170 accurately senses the hydraulic pressure P and produces an electrical signal 173 on line 174 in response to an excitation signal 175 on line 176 from the meter 162'. In turn, the electrical signal 173 is converted to a force value, which is representative of the force F1 of FIG. 1, and is displayed in digital form by the meter 162'. As shown in FIG. 1, the meter 162' is mounted on a mounting plate 177 on the top of the frame 16. The meter 162 of FIG. 8 is mounted in a similar manner.

Figure 10:
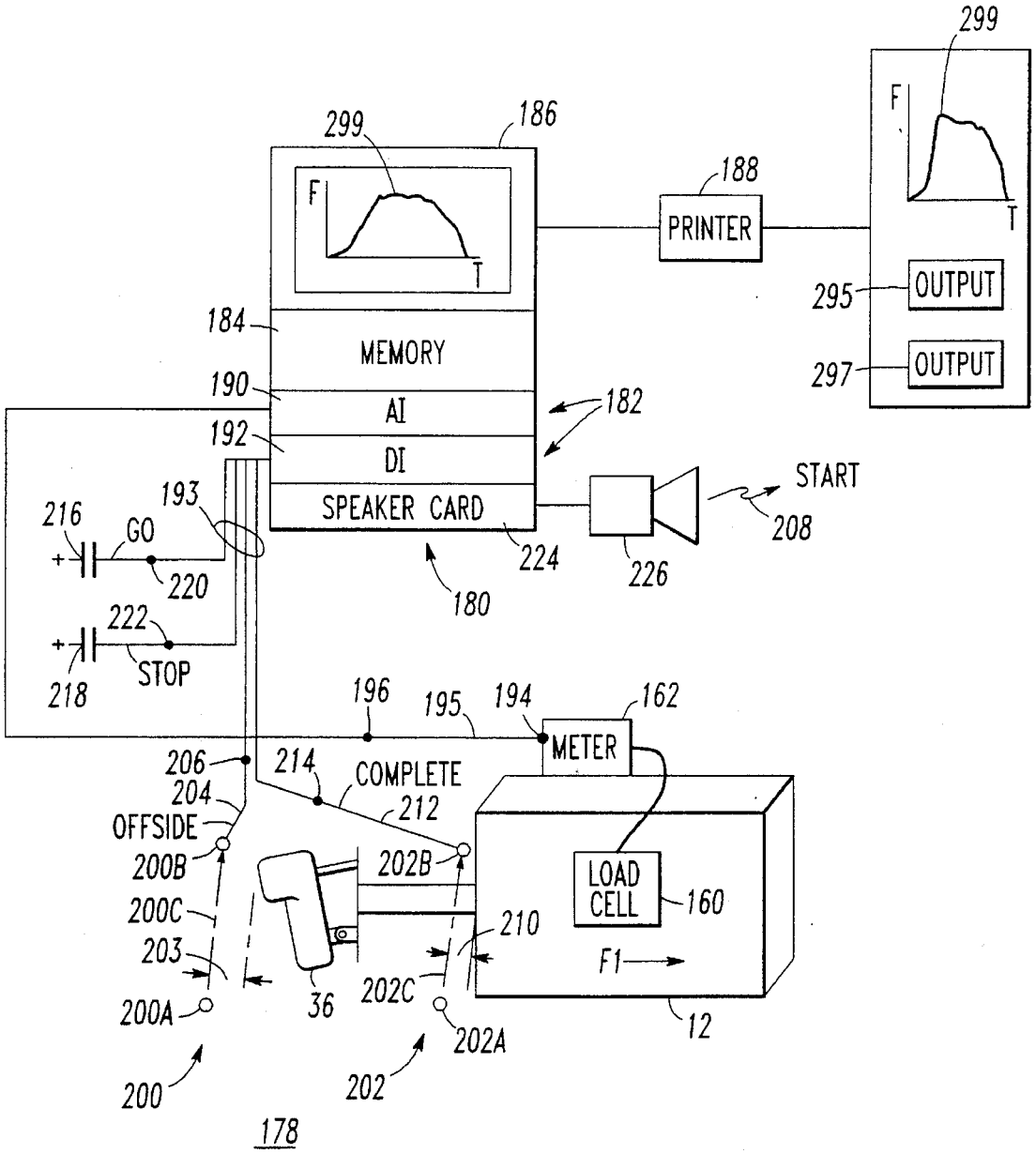
FIG. 10 is a schematic diagram of a processing subsystem of a football training machine in accordance with another alternative embodiment of the invention.

FIG. 10 is a schematic diagram of a processing sub-system 178 for use with the load cell 160 and meter 162 of FIG. 8. As discussed above, the load cell 160 has an output signal which is related to the force F1. The exemplary sub-system 178 includes a processor, such as the exemplary personal computer (PC) 180, which includes an input sub-system 182, a memory 184, a display 186, and a printer 188. The input sub-system 182 includes an analog input (AI) module 190 and a digital input (DI) module 192 which interfaces a plurality of digital inputs 193.

As discussed with FIG. 8, the load cell 160 senses the force F1 which is converted and displayed in digital form by the meter 162. The meter 162 has an analog output (AO) port 194 with an AO signal 195 representative of the force F1. The port 194 is connected by a line 196 to the AI module 190. The AI module 190 performs an analog-to-digital (A/D) conversion, as understood by those skilled in the art, of the signal 195 to a corresponding digital value representative of the force F1.

A pair of position sensors 200,202 are disposed on opposite sides of the blocking pad 36 of FIG. 1. The first sensor 200 includes an emitter 200A and a detector 200B which senses the presence of a light beam 200C therebetween. The light beam 200C from the emitter 200A to the detector 200B is located a predetermined distance 203 (e.g., 6 inches) from the blocking pad 36. The detector 200B outputs a digital OFFSIDE signal 204 on line 206 whenever the beam 200C is broken. In turn, as discussed below with FIGS. 11A–11C, the PC 180 determines whether the blocking pad 36 is being approached by an object, such as an athlete, before an audible START signal 208 is provided.

The second sensor 202 includes an emitter 202A and a detector 202B which senses the presence of a light beam 202C therebetween. The light beam 202C from the emitter 202A to the detector 202B is located a predetermined distance 210 from the frame mechanism 12. The detector 202B outputs a digital COMPLETE signal 212 on line 214 whenever the beam 202C is broken and, therefore, senses when the blocking pad 36 is at about the final position 124 of FIG. 6.

Switches 216 and 218 provide GO and STOP signals on lines 220 and 222, respectively. The digital signals on lines 206,214,220,222 collectively form the digital inputs 193 to the DI module 192. These inputs 193 are converted to discrete digital values for use by the PC 180. The PC 180 also includes a speaker card 224 which drives an external speaker 226 that provides the audible START signal 208 therefrom. The exemplary START signal 208 is a tone of a particular amplitude and frequency, although a command (e.g., "start"), a snap count (e.g., "47 23 14 hike" where "hike" is recognized as the starting signal), or any other audible signal or signals which are recognizable as a starting signal may be provided. As further explained in FIGS. 11A–11C below, the PC 180 collects and saves in the memory 184 a plurality of force values from the load cell 160 with respect to time. The PC 180 also outputs a plot of the force values with respect to time on the display 186 and/or prints such plot using the printer 188.

Figure 11A:
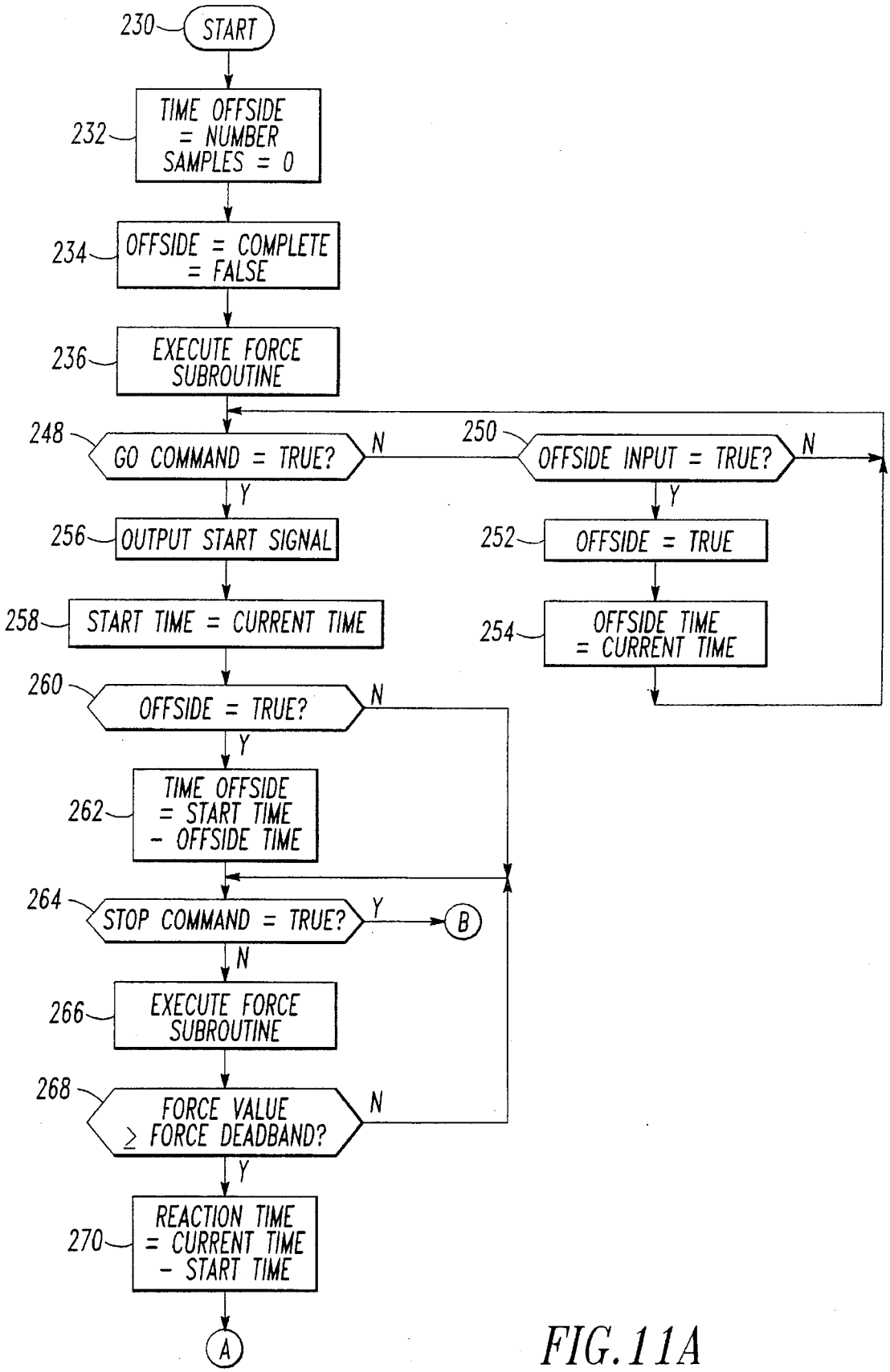
FIGS. 11A–11C are flowcharts of software executed by the processing sub-system of FIG. 10.
Figure 11B:
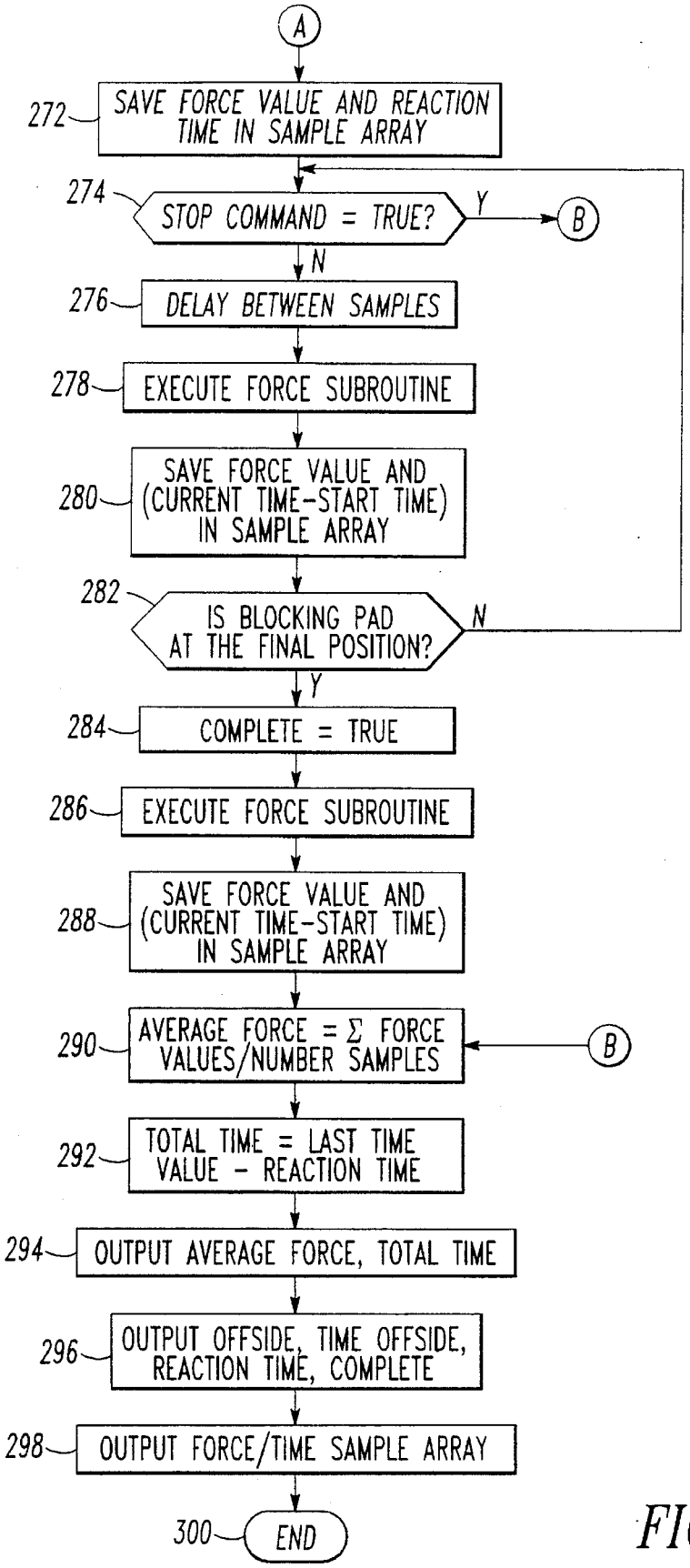
Figure 11C:
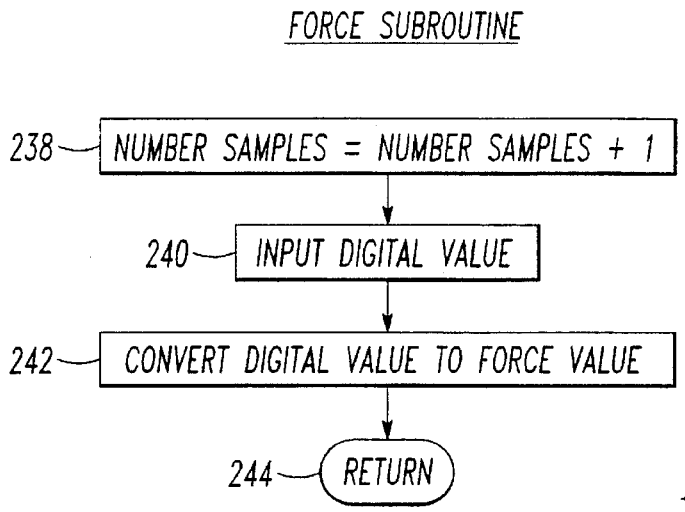

Also referring to FIGS. 11A–11C, software flowcharts of a routine executed by the exemplary PC 180 to determine, for example, a plot of the force F1 versus time, a premature charge (i.e., offside) before the START signal 208, reaction time, and total time to completely drive the blocking pad 36 to its final position are illustrated. After the routine starts at step 230, the variables TIME OFFSIDE and NUMBER SAMPLES are initialized to zero at step 232, and the logical variables OFFSIDE and COMPLETE are set false at step 234. Then, at step 236, the force subroutine of FIG. 11C is executed.

At step 238 of the force subroutine, the variable NUMBER SAMPLES is incremented. Then, a digital value representative of the AO signal 195 from the AI module 190 is input at step 240. Next, at step 242, this digital value is converted to a digital FORCE VALUE equivalent to the force F1. Finally, the force subroutine returns to the calling routine at step 244.

Next, at step 248 of FIG. 11A, a GO COMMAND, received by the DI module 192 from the switch 216, is tested. If this value is false, the OFFSIDE INPUT, received by the DI module 192 from the line 206, is tested at step 250 to determine if the signal is true and the athlete is offside. If not, step 248 is repeated. On the other hand, if the signal OFFSIDE INPUT is true, the logical variable OFFSIDE is set true at step 252. Then, at step 254, the variable OFFSIDE TIME is set to the current time, which is maintained by the PC 180 as understood by those skilled in the art, before step 248 is repeated.

Otherwise, if the GO COMMAND is true, the START signal 208 is output to the speaker 226 using the speaker card 224 at step 256, and the variable START TIME is set to the current time at step 258. As discussed below with FIG. 11B, this variable is utilized to associate the START signal 208 with a time sample value having an initially zero value. At step 260, if the logical variable OFFSIDE is true, the variable TIME OFFSIDE is set to the value of START TIME less the value of OFFSIDE TIME. Otherwise, if the logical variable OFFSIDE is false, step 262 is skipped.

In either case, execution resumes at step 264, where a STOP COMMAND, received by the DI module 192 from the switch 218, is tested. If this value is true, execution continues at step 290 of FIG. 11B. On the other hand, if there is no STOP COMMAND, at step 266, the force subroutine of FIG. 11C is executed as discussed above. Then, at step 268, the FORCE VALUE obtained at step 242 is compared to a FORCE DEADBAND value (e.g., 1 lb.). If the FORCE VALUE is less than the deadband value, no significant contact with the blocking pad 36 is assumed, and step 264 is repeated. Otherwise, at step 270, the variable REACTION TIME is set equal to the value of the CURRENT TIME less the value of the START TIME, before execution continues at step 272 of FIG. 11B.

At step 272, the sample of the variable FORCE VALUE and the calculated sample of time REACTION TIME (i.e., CURRENT TIME - START TIME) is saved in a sample array in the memory 184. In this manner, the time of the START signal 208 is defined to be zero and the time of the first sample is the value of the REACTION TIME. As discussed with Table I below, the sample array contains a plurality of FORCE/TIME pairs. Next, at step 274, the STOP COMMAND is tested as discussed above. If this value is true, execution continues at step 290 below. On the other hand, if there is no STOP COMMAND, at step 276, the PC 180 delays for a predetermined DELAY time between samples (e.g., 100 mS) before re-executing the force subroutine of FIG. 11C at step 278.

Next, at step 280, the next sample of the variable FORCE VALUE and a calculated sample of time (CURRENT TIME - START TIME) is saved in the sample array in the memory 184. At step 282, the COMPLETE signal 212, received by the DI module 192 on line 214 is tested to determine if the signal is true and the blocking pad 36 is at about the final position 124 thereof (as shown in FIG. 6). If not, step 274 is re-executed to check for the STOP COMMAND. Otherwise, the logical COMPLETE is set true at step 284, the force subroutine of FIG. 11C is re-executed at step 286, and the final sample of the variable FORCE VALUE and the final calculated sample of time (CURRENT TIME - START TIME) is saved in the sample array in the memory 184 at step 288.

As shown in Table I, a simulated sample array contains a plurality of FORCE/TIME pairs which include the FORCE VALUE at the REACTION TIME, intermediate pairs every 100 mS, and the FORCE VALUE at the COMPLETION TIME:

TABLE I

| FORCE VALUE (lbs) | TIME VALUE (S) |
|---|---|
| 12 | 0.126 (REACTION TIME) |
| 38 | 0.226 |
| 76 | 0.326 |
| 122 | 0.426 |
| 255 | 0.526 |
| 253 | 0.626 |
| 254 | 0.726 |
| 255 | 0.826 |
| 256 | 0.926 |
| 257 | 1.026 |
| 258 | 1.126 |
| 259 | 1.226 |
| 258 | 1.326 |
| 255 | 1.426 |
| 253 | 1.526 |
| 233 | 1.626 |
| 212 | 1.726 |
| 204 | 1.826 |
| 198 | 1.844 (COMPLETION TIME) |

Then, at step 290, the variable AVERAGE FORCE is calculated from the sum of the FORCE VALUES from the array divided by the NUMBER SAMPLES in the array. At step 292, the variable TOTAL TIME is calculated from the last time value (COMPLETION TIME) less the first time value (REACTION TIME). At step 294, the variables AVERAGE FORCE and TOTAL TIME are output 295 using the exemplary printer 188, and at step 296, the variables OFFSIDE, TIME OFFSIDE, REACTION TIME, and COMPLETE are output 297 using the printer 188. At step 298, a plot 299 of samples of the FORCE VALUE (F) with respect to the corresponding samples of the TIME VALUE (T) is output using the printer 188 and/or the display 186 before the routine exits at step 300.

Figure 12:
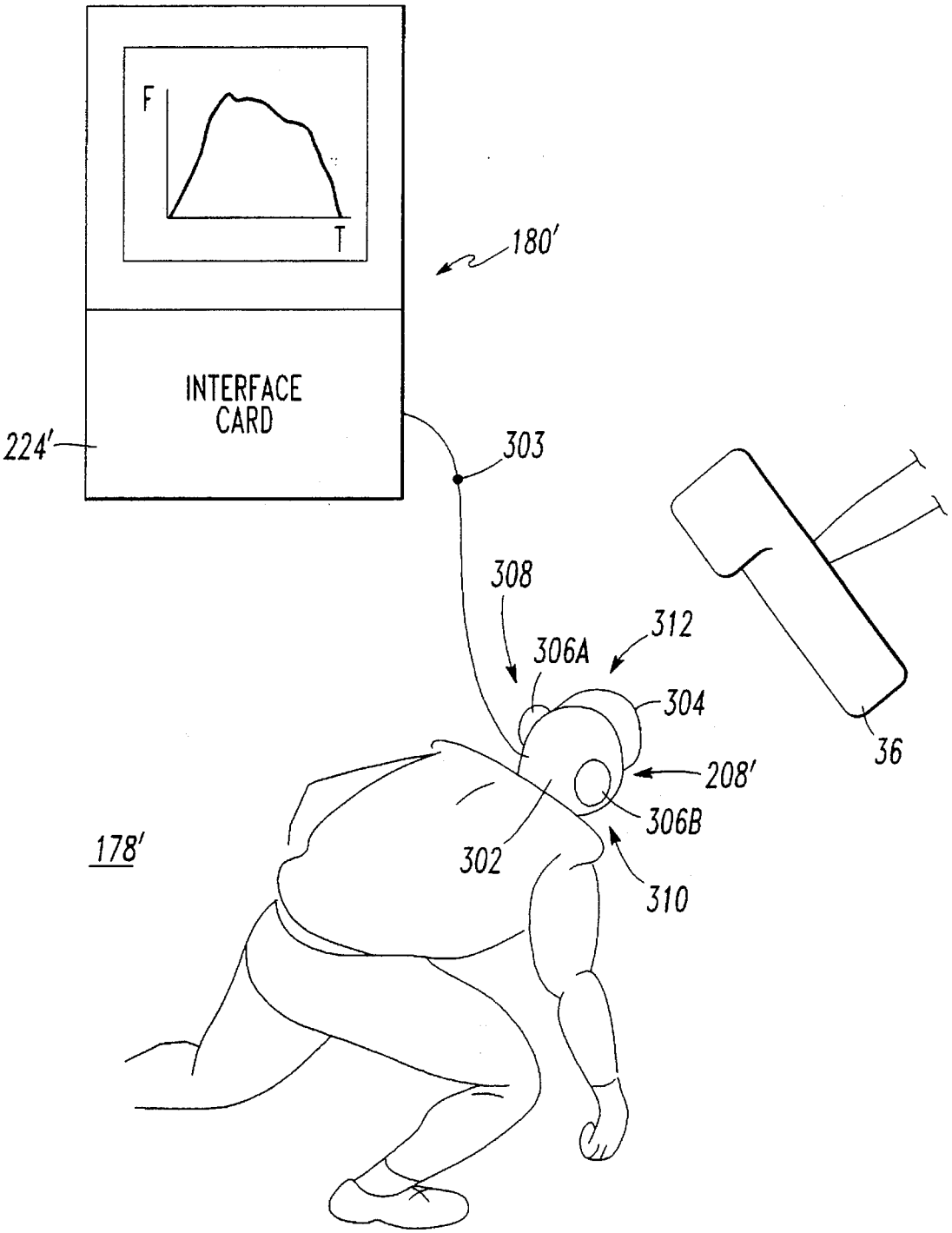
FIG. 12 is a schematic diagram of a processing subsystem of a football training machine in accordance with another alternative embodiment of the invention.

Referring now to FIG. 12, a schematic diagram of an alternative processing sub-system 178' is illustrated. The sub-system 178' and the PC 180' are generally the same as the sub-system 178 of FIG. 10. Additionally, the sub-system 178' includes a virtual-reality device such as a head-mounted display (HMD) or a virtual-reality helmet 302. The exemplary helmet 302 is interfaced by line 303 to an interface card 224'. The exemplary card 224' drives a monitor 304 and headphones 306A,306B in the helmet 302 in order to provide a virtual-reality (V-R) START signal 208' therefrom. In a similar manner as discussed above with FIGS. 11A–11C, the V-R START signal 208' is associated with the sample of the TIME VALUE having the zero value.

As discussed below with FIG. 13, the V-R START signal 208' includes two audible components 308,310 and a visual component 312. The first audible component 308 is an audible signal of background noise, such as, for example, crowd noise from an opposing team's fans at a football game. The second audible component 310 is an audible signal representative of the START signal 208 of FIG. 10. In this manner, an athlete may be trained to respond to the V-R START signal 208' under adverse conditions. The visual component 312 is output to the monitor 304 and illustrates, for example, a motion video of a snap of a football from the perspective of a football lineman.

Figure 13:
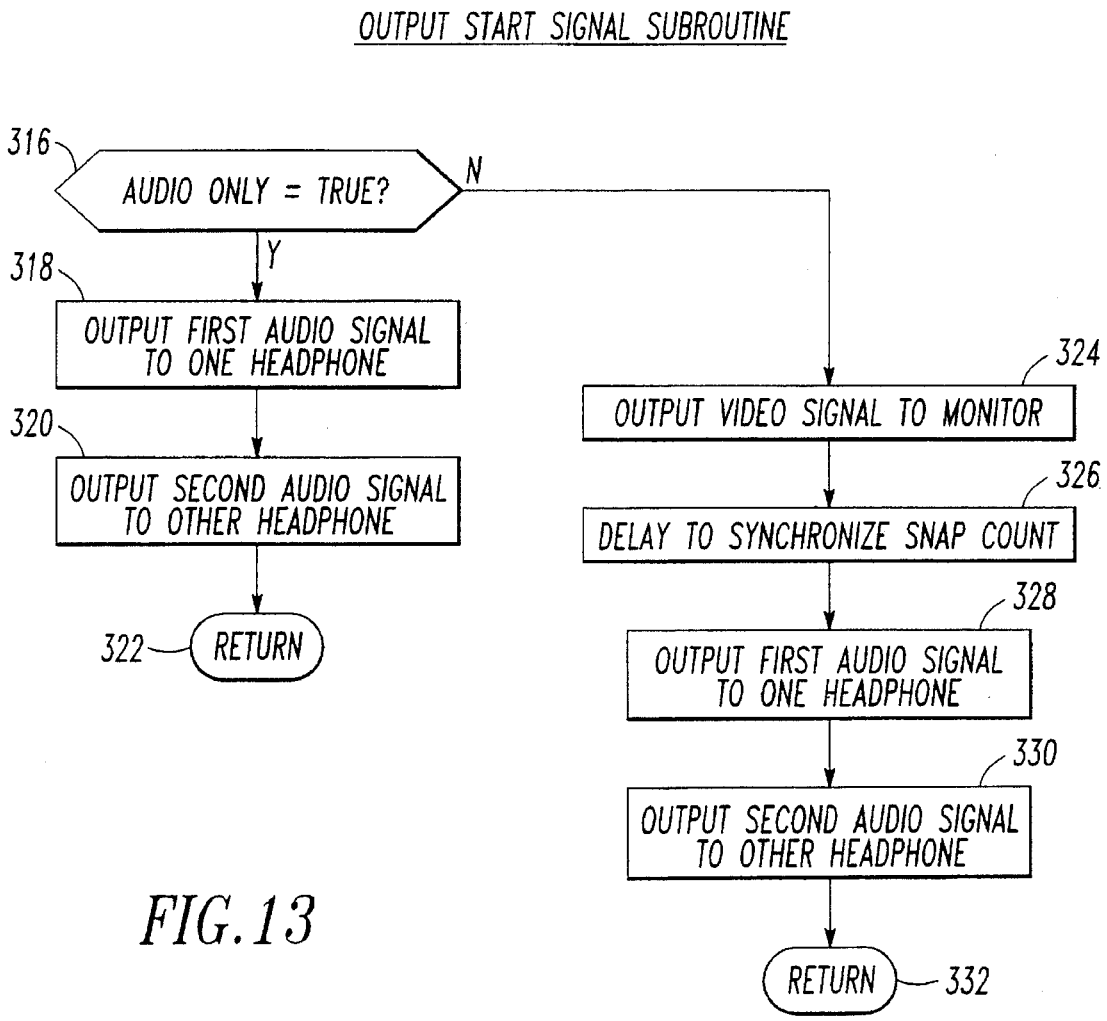
FIG. 13 is a flowchart of software executed by the processing sub-system of FIG. 12.

Also referring to FIG. 13, a software flowchart of a subroutine executed by the exemplary PC 180' for outputting the V-R START signal 208' is illustrated. When called, at step 316, a predefined logical variable AUDIO ONLY in the memory 184 is tested If this variable is true, only the audio components 308,310 are utilized. At step 318, the first audio component 308 is output to the left headphone 306A, and at step 320 the other audio component 310 is concurrently output to the right headphone 306B before the routine returns to the calling program at step 322. Those skilled in the art will appreciate that other equivalent embodiments may mix the audio components 308,310 and output a mixed audio signal to both headphones 306A,306B or to a single speaker (not shown).

On the other hand, if the logical variable AUDIO ONLY is false, both the audio components 308,310 and the visual component 312 are utilized. At step 324, the visual component 312 is output to the monitor 304. Then, at step 326, the subroutine introduces a delay to synchronize the snap count of the audio component 310 with the visual component 312. Next, at step 328, the first audio component 308 is output to the left headphone 306A, and at step 330 the other audio component 310 is concurrently output to the right headphone 306B before the routine returns to the calling program at step 332.

The exemplary football training machine 2 of FIG. 1 is useful in evaluating and/or training a football player or any athlete in terms of both speed and strength. Movement of the exemplary mechanism 4 by the athlete is resisted by the hydraulic cylinder 102, which accommodates the force F1 applied to the blocking pad 36 without undue fatigue while readily permitting sensing and measurement of the resulting pressure or force. The exemplary valve 128 and accumulator 130 dissipate the energy from the cylinder 102 and away from the blocking pad 36 in order that the cylinder 102 has no stored energy which would otherwise cause an undesirable recoil of the blocking pad 36 into the athlete.

The sensing sub-systems 158,158' of FIGS. 8 and 9 further determine the general blocking effectiveness of a person and, more particularly, contemporaneously and accurately specify the charging force of the athlete. The processing sub-systems 178,178' of FIGS. 10 and 12 further record the plot of the charging force versus time; determine whether the athlete is offside; and calculate reaction time, average force and total time to completely drive the blocking pad 36 to its final position. The processing sub-system 178' and virtual-reality helmet 302 facilitate evaluation of the athlete under simulated real world conditions. The machine 2 further includes an independent returning mechanism 10 which safely returns the blocking pad 36 to its initial position in order that the machine 2 may be used in closely spaced successive charges by the same or different person.

While we have illustrated and described a present preferred embodiment of our invention, it is to be understood that we do not limit ourselves thereto and that our invention may be otherwise variously practiced within the scope of the following claims.

We claim:

1. Apparatus for use in conditioning a football player, said apparatus comprising:

blocking pad means for movement in a first direction from a first position to a second position by a first force which is applied to said blocking pad means;

resisting means interconnected with said blocking pad means for resisting movement of said blocking pad means in the first direction with a second force which opposes the first force;

dissipating means cooperating with said resisting means for dissipating all of the second force away from said blocking pad means when the first force is removed from said blocking pad means;

returning means for returning said blocking pad means from the second position to the first position in a second direction, which is opposite from the first direction, with a predetermined independent third force;

frame means for supporting at least said resisting means; and sensing means for at least sensing the first force.

2. The apparatus of claim 1 wherein said blocking pad means has a speed of movement in the first direction in response to the first force; and wherein said resisting means includes means for adjusting the speed of movement in response to the first force.

3. The apparatus of claim 1 wherein said resisting means includes hydraulic cylinder means having movable rod means connected to said blocking pad means, the movable rod means being movable by said blocking pad means in the first direction and resisting movement of said blocking pad means in the first direction with the second force.

4. The apparatus of claim 3 wherein the hydraulic cylinder means further has a hydraulic cylinder holding hydraulic fluid and a piston which is driven by the movable rod means, the hydraulic cylinder having a port for transferring the hydraulic fluid therefrom when the piston is driven by the movable rod means in the first direction; and wherein said resisting means further includes flow control means for controlling a flow rate of the hydraulic fluid, the flow control means interconnected with the port, the hydraulic fluid flowing from the port and through the flow control means in response to movement of the movable rod means in the first direction.

5. The apparatus of claim 4 wherein said blocking pad means has a speed of movement in the first direction in response to the first force; and wherein the flow control means includes means for adjusting the speed of movement in response to the first force.

6. The apparatus of claim 4 wherein the hydraulic fluid in the hydraulic cylinder has a hydraulic pressure in response to the first force; wherein the flow control means reduces the hydraulic pressure of the hydraulic fluid as a function of the flow rate of the hydraulic fluid from the port and through the flow control means; and wherein said dissipating means includes accumulator means for holding the hydraulic fluid which flows from the port and through the flow control means.

7. The apparatus of claim 6 wherein the accumulator means includes holding means for holding the hydraulic fluid which flows from the port and through the flow control means; and wherein said returning means includes compressing means for compressing the holding means with a generally predetermined pressure, and also includes hydraulic fluid return means interconnected between the holding means and the port for freely permitting a flow of the hydraulic fluid from the holding means to the port whenever the pressure of the compressing means exceeds the hydraulic pressure of the hydraulic fluid in the hydraulic cylinder.

8. The apparatus of claim 4 wherein the hydraulic fluid in the hydraulic cylinder has a hydraulic pressure which is related to the first force; and wherein said sensing means includes means for sensing the hydraulic pressure.

9. The apparatus of claim 8 wherein the means for sensing the hydraulic pressure is a pressure transmitter.

10. The apparatus of claim 8 wherein the pressure transmitter outputs a pressure signal which is related to the first force; and wherein said sensing means further includes means for inputting the pressure signal, converting the pressure signal to a force value, and displaying the force value.

11. The apparatus of claim 3 wherein the hydraulic cylinder means has a longitudinal axis; wherein the movable rod means is movable along the longitudinal axis; wherein said frame means includes a pair of bearing shafts which are parallel to the movable rod means; and wherein said blocking pad means includes a blocking pad, sliding means slidable on the bearing shafts, and an extension arm connecting the blocking pad and the sliding means; the movable rod means connected to the sliding means and movable therewith.

12. The apparatus of claim 11 wherein the sliding means includes a pair of parallel plates and means interconnecting the plates, each of the plates having two bores along the longitudinal axis, each of the bores of the plates having a bearing means for slidably engaging a corresponding one of the bearing shafts.

13. The apparatus of claim 1 wherein said resisting means produces the second force in response to the first force; and wherein said sensing means includes load cell means for sensing the first force.

14. The apparatus of claim 13 wherein said sensing means further includes means for displaying the first force.

15. The apparatus of claim 14 wherein the means for displaying the first force is a digital meter.

16. Apparatus for use in evaluating a football player, said apparatus comprising:

blocking pad means for movement in a first direction from a first position to a second position by a first force which is applied to said blocking pad means;

resisting means interconnected with said blocking pad means for resisting movement of said blocking pad means in the first direction with a second force which opposes the first force;

dissipating means cooperating with said resisting means for dissipating all of the second force away from said blocking pad means when the first force is removed from said blocking pad means, said resisting means having an output with a signal which is related to the first force;

returning means for returning said blocking pad means from the second position to the first position in a second direction, which is opposite from the first direction, with a predetermined independent third force;

frame means for supporting at least said resisting means;

and processor means for inputting the signal from said resisting means and determining the first force.

17. The apparatus of claim 16 wherein said processor means includes input means for inputting the signal, converting means for converting the signal to a force value equivalent to the first force, and output means for outputting the force value.

18. The apparatus of claim 17 wherein said processor means further includes means for collecting a plurality of samples of a time value and also collecting a plurality of samples of the force value, each sample of the time value associated with a corresponding sample of the force value; and wherein the output means outputs at least some of the samples of the force value with the corresponding samples of the time value.

19. The apparatus of claim 18 wherein one of the samples of the time value has an initial value; and wherein said processor means further includes means for outputting a start signal associated with the sample of the time value having the initial value, and sensing means located at a predetermined distance from said blocking pad means for determining whether said blocking pad means is being approached by an object before the start signal.

20. The apparatus of claim 18 wherein one of the samples of the time value has an initial value; and wherein said processor means further includes means for outputting a start signal associated with the sample of the time value having the initial value, and means for determining when the first force was applied to said blocking pad means with respect to the start signal.

21. The apparatus of claim 18 wherein said blocking pad means moves from an initial position to a final position in the first direction; wherein said resisting means resists movement of said blocking pad means in the first direction from the initial position to the final position; wherein said processor means further includes means for outputting a start signal associated with one of the samples of the time value having an initial value, and means for sensing when in time said blocking pad means is at about the final position thereof; and wherein the output means outputs at least some of the samples of the force value with the corresponding samples of the time value including the sample of the time value having the initial value, and the sample of the time value when said blocking pad means is at about the final position thereof.

22. The apparatus of claim 21 wherein said processor means includes means calculating a difference between the sample of the time value when said blocking pad means is at about the final position thereof and the sample of the time value having the initial value, and also includes means calculating an average of the samples of the force value.

23. The apparatus of claim 18 wherein one of the samples of the time value has an initial value; and wherein said processor means further includes virtual-reality means for enunciating a start signal associated with the sample of the time value having the initial value.

24. The apparatus of claim 23 wherein the virtual-reality means for enunciating the start signal includes speaker means for outputting an audible start signal.

25. The apparatus of claim 24 wherein the audible start signal includes a first audible signal representative of the start signal and a second audible signal representative of background noise.

26. The apparatus of claim 23 wherein the virtual-reality means for enunciating the start signal includes display means for outputting a visual start signal.

27. The apparatus of claim 23 wherein the virtual-reality means for enunciating the start signal includes speaker means for outputting an audible start signal and display means for outputting a visual start signal.

28. Apparatus for use in conditioning strength, said apparatus comprising:

moving means for movement in a first direction from a first position to a second position by a first force which is applied to said moving means;

resisting means interconnected with said moving means for resisting movement of said moving means in the first direction with a second force which opposes the first force;

dissipating means cooperating with said resisting means for dissipating all of the second force away from said moving means when the first force is removed from said moving means;

returning means for returning said moving means from the second position to the first position in a second direction, which is opposite from the first direction, with a substantially predetermined third force; and frame means for supporting at least said resisting means.

* * * * *